United States Patent [19]

Mullendore et al.

[11] Patent Number: 4,458,599

[45] Date of Patent: Jul. 10, 1984

[54] FRANGIBLE TUNGSTEN PENETRATOR

[75] Inventors: James A. Mullendore, Towanda, Pa.; Scott K. Reiman, Auburn Heights, Mich.; Andrew J. Kegel, Ulster, Pa.

[73] Assignee: GTE Products Corporation, Stamford, Conn.

[21] Appl. No.: 296,758

[22] Filed: Aug. 27, 1981

Related U.S. Application Data

[63] Continuation-in-part of Ser. No. 250,334, Apr. 2, 1981, abandoned.

[51] Int. Cl.[3] ..... B22F 3/16; F42B 13/04; F42B 13/18

[52] U.S. Cl. ..... 102/517; 419/28; 419/29; 75/248

[58] Field of Search ..... 102/513, 517, 518, 519; 75/200, 248; 419/28, 29

[56] References Cited

U.S. PATENT DOCUMENTS

| | | | |
|---|---|---|---|
| 3,302,570 | 2/1967 | Marquardt | 102/519 |
| 3,685,134 | 8/1972 | Blue | 75/248 |
| 3,888,636 | 6/1975 | Sczerzenie | 75/248 |
| 3,946,673 | 3/1976 | Hayes | 102/52 |
| 3,979,234 | 9/1976 | Northcutt, Jr. et al. | 148/126 |

FOREIGN PATENT DOCUMENTS

| | | |
|---|---|---|
| 0051375 | 5/1982 | European Pat. Off. . |
| 538268 | 7/1941 | United Kingdom . |

OTHER PUBLICATIONS

Lenel, *Powder Metallurgy,* N.J., Metal Powder Industries Federation, 1980, pp. 239–241.

*Primary Examiner*—Brooks H. Hunt
*Assistant Examiner*—Anne Brookes
*Attorney, Agent, or Firm*—Donald R. Castle

[57] ABSTRACT

A material consisting essentially of tungsten having from 5 to about 20 grains per square millimeter and a hardness on the Rockwell C scale from about 31 to about 35 is suited for armor penetration.

5 Claims, No Drawings

FRANGIBLE TUNGSTEN PENETRATOR

RELATED APPLICATION

This application is a continuation-in-part of U.S. application Ser. No. 250,334, filed Apr. 2, 1981 and now abandoned.

FIELD OF INVENTION

This invention relates to a specific tungsten material having the proper degree of frangibility and hardness to enable it to be used in armor penetrators.

BACKGROUND

Penetrators for armor piercing shells have in the past been prepared from materials that have the desired strength and density to penetrate armor.

A more desirable material would not only have the density and strength to penetrate the armor, but also be capable of being broken into pieces of an intermediate size. If the material is too strong then either no particles or a small number will be formed thus creating only local damage. If, however, the material breaks into very fine particles, the resulting particles will not penetrate and do little or no damage.

Some materials in the past have been tungsten alloys with minor amounts of iron, nickel or copper. While these materials have the strength and density to allow penetration of armour when fired from a conventional weapon such as an anti-tank gun, they do not possess the desired frangibility characteristics to enable them to break apart upon impact to form particles in the desired size range.

It is believed, therefore, a material having a sufficient strength and hardness to enable penetration of light armour and with a desired amount of frangibility to enable the material to fragment in a desirable manner would be an advancement in the art.

DETAILED EMBODIMENTS

For a better understanding of the present invention, together with other and further objects, advantages and capabilities thereof, reference is made to the following disclosure and appended claims in connection with the above description of some of the aspects of the invention.

The above desirable properties are achieved in one aspect of this invention which consists of a tungsten material having from about 5 to about 20 grains per square millimeter of cross-section area and a hardness, as measured on the Rockwell C hardness scale, of from about 31 to about 35.

These materials are prepared by a process wherein conventional tungsten metal powder is pressed into a bar of a predetermined size using conventional powder metallurgy procedures.

The bar is presintered at a temperature of from about 1100° C. to about 1300° C. for about 10 minutes and thereafter sintered at a temperature of from about 2700° C. to about 2900° C. for a time sufficient to achieve a density of from about 17.3 g/cm$^3$ to about 18.1 g/cm$^3$. Usually about 1 hour is sufficient to achieve the desired density.

After the foregoing density is achieved the bar is elongated sufficiently to achieve from about 30% to about 40% reduction in cross section. Conventional swaging is the preferred method of elongation. A typical bar prior to elongation has a length of about 90 cm and a cross-sectional area of 650 mm$^2$. The material is machined to the desired penetrator shape.

After machining the material is annealed at a temperature of from about 1700° C. to about 1900° C. to achieve a material containing from about 5 to about 20 grains per square millimeter and a hardness measured on the Rockwell C scale from about 30 to about 35.

In some armor penetrators it is desired to have a tracer cavity in a rear portion of the penetrator. If the portion containing the cavity for the tracer is annealed and recrystallized there can be premature cracking. In the instance where the cavity is desired, the annealing can be done on the body and nose poriton while leaving the rear portion unannealed and unrecrystallized thus enabling the cavity for the tracer to be machined into the rear portion. Induction heating is the preferred method of annealing in such instances. In most instances the unannealed portion will extend from about 10% to about 35% of the total length, with from about 15% to 25% of the total length being preferred.

The following detailed examples are presented to show the effectiveness of the present invention.

EXAMPLE I

An ingot produced from conventional tungsten powder having near theoretical density is swaged to a rod having a diameter of about 0.725 inches and a penetrator is machined from the rod. The material has a fine grain structure having over 1000 grains per square millimeter. The hardness on a Rockwell C hardness ranges from about 35 to about 43 depending upon the point of measurement. The penetrator did not have the degree of frangibility desired and would not break apart into small particles.

EXAMPLE II

A conventional M25 tungsten powder with 0.25% nickel addition is pressed into a blank. The blank is sintered at about 1550° C. to achieve a density of about 94% of theoretical. The Rockwell C hardness ranged from about 24.8 to about 30.6 depending upon the point of measurement. The penetrator machined from the blank failed before it got out of the barrel because of its extreme brittleness.

EXAMPLE III

A penetrator prepared as in Example I is annealed at about 1800° C. for about 10 hours to give a recrystallized structure containing from about 5 to about 20 grains per square millimeter of cross section. The Rockwell C hardness ranges from about 30 to about 34 depending upon the point of measurement. Excellent results are obtained when fired against (a) 11 ¼ inch aluminum plates (b) 1 inch armor plate at 60° and against 2 inch armor plate. Penetration is achieved and the penetrator breaks into individual grains.

EXAMPLE IV

The procedure given in Example III is followed except the rear portion constituting about 20% of the total length is not annealed and left in an uncrystallized state. The small tracer cavity is machined into the rear portion of the penetrator. Substantially similar results to those obtained with the penetrator of Example III are achieved.

While there has been shown and described what are at present considered the preferred embodiments of the invention, it will be obvious that various changes and modifications may be made therein without departing from the scope of the invention as defined by the appended claims.

What is claimed is:

1. A penetrator for armor consisting essentially of a body of tungsten having from about 5 to about 20 grains per square millimeter and a hardness of from about 31 to about 35 on the Rockwell C hardness scale.

2. A penetrator according to claim 1 wherein a rear portion constituting from about 10% to about 35% of the total length is in an unannealed and unrecrystallized state.

3. A process for producing a frangible tungsten product comprising (a) pressing tungsten powder having an average grain size of from about 1 to about 25 microns to form a bar of a predetermined cross-sectional area, (b) sintering said bar in a non oxidizing atmosphere at a temperature of from about 2700° C. to about 2900° C. for a sufficient time to attain a density in said bar of from about 17.3 g/cm$^3$ to about 18.1 g/cm$^3$, (c) elongating said bar to achieve about 30% to about 40% reduction in cross-sectional area, (d) machining the resulting bar to form penetrators of predetermined shape, and (e) annealing at least a portion of said penetrator at a temperature of from about 1700° C. to about 1900° C. for a sufficient time to achieve a material having from about 5 to about 20 grains per square millimeter, and a hardness measuring from about 31 to about 35 on the Rockwell C hardness scale.

4. A process according to claim 3 wherein all of said penetrator is annealed.

5. A process according to claim 3 wherein a rear portion constituting from about 10% to about 35% of the total length is unannealed.

* * * * *